United States Patent [19]

Vuletic et al.

[11] Patent Number: 4,891,062

[45] Date of Patent: Jan. 2, 1990

[54] METHOD FOR OPERATING AND MELT-DOWN GASIFIER HAVING WATER-COOLED NOZZLES FOR OXYGEN AND MEANS FOR MONITORING WATER AND OXYGEN

[75] Inventors: Bogdan Vuletic, Duesseldorf, Fed. Rep. of Germany; Michael Nagl, Marien; Leopold Seirlehner, Linz; Welfried Pirklbauer, Niedesnenkirchen, all of Austria

[73] Assignee: Deutsche Voest-Alpine Industrieanlagenbau GmbH, Duesseldorf, Fed. Rep. of Germany

[21] Appl. No.: 280,596

[22] Filed: Dec. 6, 1988

[30] Foreign Application Priority Data

Dec. 10, 1987 [DE] Fed. Rep. of Germany ..... 3742156

[51] Int. Cl.[4] ..... F27D 19/00; C21B 13/14

[52] U.S. Cl. ..... 75/28; 75/26; 75/38; 266/47; 266/83; 266/172; 266/270

[58] Field of Search ..... 75/26, 38, 40, 43, 28; 266/172, 47, 83; 422/140

[56] References Cited

U.S. PATENT DOCUMENTS 4,047,937 9/1977 Kolb et al. ..... 75/59.13

4,396,421 8/1983 Stift et al. ..... 75/26

*Primary Examiner*—Melvyn J. Andrews

*Attorney, Agent, or Firm*—Barnes & Thornburg

[57] ABSTRACT

Described is a method for operating a melt-down gasifier(4) in which iron-ore-containing charge materials or iron sponge obtained from same by direct reduction are smelted due to the addition of carbon carriers and blowing an oxygen-containing gas through oxygen nozzles (6) into a fluidized bed created by same, and are (further) reduced to make liquid pig iron or steel starting material. On failure or reduction of the oxygen supply below a predetermined quantity and on failure of the water cooling system of the oxygen nozzles, the still present oxygen supply is cut-off and an inert gas is fed into the melt-down gasifier through the said oxygen nozzles instead, for protecting said oxygen nozzles. Thus, liquid fluidized bed matter is prevented from penetrating into the oxygen nozzles and to solidify in same. In the case of failure of the water cooling system of the oxygen nozzles, the inert gas serves also at the same time as cooling medium.

10 Claims, 1 Drawing Sheet

METHOD FOR OPERATING AND MELT-DOWN GASIFIER HAVING WATER-COOLED NOZZLES FOR OXYGEN AND MEANS FOR MONITORING WATER AND OXYGEN

BACKGROUND OF THE INVENTION

The invention relates generally to a method for operating a melt-down gasifier or other apparatus for making liquid pig iron or steel starting material, which apparatus includes water cooled nozzles for introducing a measured quantity of oxygen-containing gas into the apparatus at as normal operating pressure. The invention relates specifically to the operation of such an apparatus in the event of a reduction of the supply of water for cooling the nozzles.

From DE-PS 30 34 539, a method for the direct production of molten pig iron from lumpy iron ore is known, in the course of which the iron ore is reduced to iron sponge in a reduction blast furnace by means of hot reduction gas, and is subsequently fed to a melt-down gasifier. In this gasifier, the heat and the reduction gas required are produced from charged coal and blown-in oxygen-containing gas. A fluidized bed is formed of the coal charged from above and the oxygen-containing gas blown into the lower part of the gasifier. The iron sponge particles likewise fed from above are slowed down and smelted in the fluidized bed. Radial oxygen nozzles which are fed from a ring conduit are provided at equal height and distributed over the perimeter of the meltdown gasifier for blowing-in the oxygen-containing gas. The nozzles are necessarily water-cooled in order to withstand the high temperatures prevailing in the interior of the melt-down gasifier and in particular in front of said nozzles. In this area in front of the nozzles, the fluidized bed is converted into a pasty or liquid matter due to the high temperatures prevailing there.

If a sudden failure of the feed of the said oxygen-containing gas occurs, said pasty or liquid mass is pressed outward into said water-cooled nozzles and solidifies therein. If subsequently the melt-down gasifier is again put into operation, the oxygen-containing gas cannot, or only in reduced quantity, be blown-in on account of the clogged nozzles.

Analogous problems arise from a scheduled stop of operation of the said melt-down gasifier with a slow reduction of operating pressure and reduction of the quantity of oxygen-containing gas. As the quantity of oxygen-containing gas is reduced, of, the flow the gas is no longer guaranteed through all nozzles. The pasty or liquid mass in the interior of the melt-down gasifier then penetrates into at least part of said oxygen nozzles and solidifies therein due to the water cooling. When the melt-down gasifier is again taken into operation, the oxygen-containing gas car flows in small quantities out of control through the channels between the cold nozzle extensions and the brick lining of the gasifier due to the clogging of the nozzles. Flame-ups and uncontrolled combustion occur at the hot spots, the flame directing itself also against the brick-work and even against the plate lining of the gasifier so that damage to same is unavoidable.

A failure of the cooling-water supply system for the nozzles results necessarily in damage to the nozzles. A failure of the cooling-water can cause the failure of the whole installation, so that there is the danger of liquid or pasty fluidized bed matter penetrating into the said nozzles and clogging the same.

An object of the present invention is therefore to prevent the clogging of the oxygen nozzles due to penetrating and subsequent solidification of fluidized bed matter in the case of the above mentioned failures or also scheduled changes during the operation of a melt-down gasifier, and also to prevent a thermal load on the nozzles in case of failure of the cooling-water supply to said nozzles which would cause damage thereof.

SUMMARY OF THE INVENTION

The object of the present invention is achieved by providing the melt-down gasifier or similar apparatus with monitoring means for monitoring the supply of water and oxygen-containing gas to the nozzles of the apparatus. Means is coupled to the monitoring means for terminating the supply of oxygen-containing gas to the nozzles upon the detection by the monitoring means of any reduction of the supply of either the water or the oxygen-containing gas below a predetermined quantity. Means is coupled to the nozzles for feeding an inert gas from a supply thereof into the nozzles in an initial amount sufficient to maintain the pressure within the apparatus for an initial period of time following any termination of supply of oxygen-containing gas. And means is provided for reducing the quantity of inert gas into the nozzles after the initial period of time to an amount sufficient to prevent nozzle constriction or damage.

By cutting-off the supply of oxygen-containing gas in case of failure or reduction of gas supply below a predetermined quantity or in case of failure of the water-cooling system of the nozzles, and blowing an inert gas through the oxygen nozzles into the melt-down gasifier instead, free passage through the nozzles can be safeguarded, so that the oxygen-containing gas can again controlledly be blown-in on restart and the reaction between said gas and the carbon carrier can develop as planned. The inert gas acts at the same time as a coolant on failure of the coolant water supply for the emergency cooling of said nozzles. The inert gas together with the water remaining in the nozzles solidifies the pasty fluidized bed matter at the front faces of said nozzles, protecting thus the nozzles additionally from being penetrated by not yet solidified fluidized bed matter.

The required quantity of inert gas depends on the operating pressure of said melt-down gasifier at the moment of the occurrence triggering the introduction of said inert gas. Since a specific operating pressure can be correlated with everyone of such occurrences, the quantity of the inert gas blown-in can in practice be controlled depending on which occurrence has triggered such introduction.

BRIEF DESCRIPTION OF THE DRAWINGS

Taking reference to the embodiments as represented in the following figures, the invention is described more into details. Such figures represent.

DESCRIPTION OF ILLUSTRATED EMBODIMENTS

Figure 1:
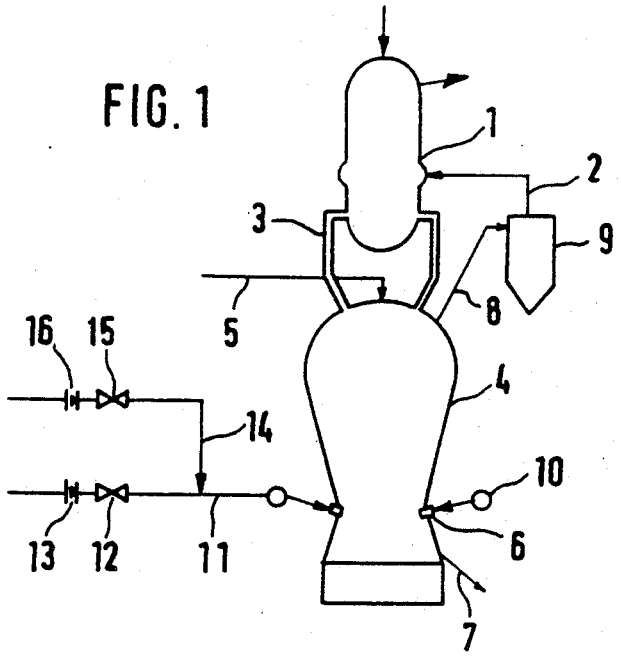
FIG. 1 a schematic view of a plant for the production of pig iron in accordance with a first embodiment, and FIG. 2 a schematic view of a plant for the production of pig iron in accordance with a second embodiment.
Figure 2:
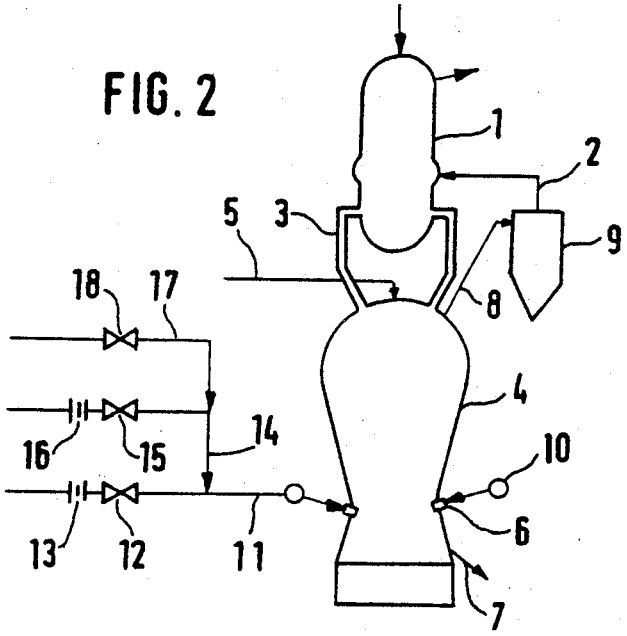

The plants according to the FIGS. 1 and 2 each contain a direct reduction blast furnace 1 built in a known manner, to which iron ore and, if required, flux material are added from above. A line 2 supplies reduction gas into the lower area of the said blast furnace 1, which ascends in same and reduces the iron ore descending in countercurrent. The consumed reduction gas is withdrawn from the upper area of the blast furnace 1 as blast-furnace gas.

The iron sponge produced by the reduction of the iron ore falls through fall tubes 3 into a melt-down gasifier 4 into which, in addition, a solid carbon carrier such as coal or coke is supplied through a line 5, and an oxygen-containing gas is blown-in through nozzles 6. The fall tubes 3 and the line 5 discharge into the upper area, and the nozzles 6 into the lower area of the said melt-down gasifier 4.

The ascending oxygen-containing gas and the carbon carrier particles descending in countercurrent form a fluidized bed in the melt-down gasifier 4, which at first slows-down the said iron sponge particles falling downward, and in which they melt due to the heat produced by the reaction of the carbon carrier with the oxygen. The liquid pig iron collecting on the bottom of the melt-down gasifier 4 and the liquid slags floating on same are periodically tapped through a tap 7.

The gas produced by the reaction of the carbon carrier with the oxygen is withdrawn out of the melt-down gasifier 4 through a line 8 and purified in a cyclone 9 before it flows into the blast furnace 1 through the line 2, after being cooled down to a suitable temperature, if required.

The nozzles 6 being equally spaced around the perimeter of the melt-down gasifier 4 at the same height are connected with a closed-circuit pipe line 10 to which the oxygen-containing gas is supplied by a line 11. A control valve 12 and a flowmeter 13 are inserted in that line 11. The quantity of the oxygen-containing gas supplied is thus measured by the flowmeter 13 and controlled by the control valve 12.

An inert gas, in particular nitrogen, can be fed into line 11 through line 14 which discharges into line 11. A control valve 15 and a flowmeter 16 are likewise inserted into said line 14.

In the embodiment according to FIG. 1, the control valve 12 for the oxygen-containing gas closes automatically and the control valve 15 for the inert gas opens automatically when the flow quantity as found by the flowmeter 13 falls below a predetermined limit, so that inert gas flows through the nozzles 6 into the melt-down gasifier 4 instead of the oxygen-containing gas. The blown-in inert gas prevents the nozzle openings from being clogged by the penetrating liquid and then solidifying fluidized bed matter. The inert gas can act at the same time as cooling medium for the nozzles and protect same from too high a thermal load when the cooling water supply to same fails.

The reduction of the feed of oxygen-containing gas may have various reasons. It may occur abruptly in case of a failure, or it may also be made continuously when the plant is shut down on purpose.

The supply of the inert gas is preferably controlled depending on time, so that initially the maximum gas quantity possible for the respective occurrence is routed through the nozzles 6, and subsequently a controlled reduction is effected via the control valve 15. The initial quantity of inert gas depends on what occurrence is triggering the supply of the said gas, or on the operating pressure prevailing in the melt-down gasifier 4 at the moment of the occurrence. It has proven to be advantageous to adjust this quantity to approximately 15% of the normal quantity of the oxygen-containing gas after a slow reduction of the operating pressure and the oxygen supply during the scheduled shut-off of the melt-down gasifier, and to approximately 25% in case of a failure with a sudden interruption of the oxygen supply at normal operating pressure, and to approximately 30% when the water-cooling system fails and the inert gas has to take up an additional cooling function.

In the embodiment according to FIG. 2, a supplementary line 17 into which a control valve 18 is inserted and which is likewise used for the supply of inert gas, discharges into line 14. The inert gas can thus be supplied through two parallel lines, a larger quantity being supplied through the line 14 than through the line 17. The control mechanism of the control valves 15 and 18 works in a manner so that, at the begin of the supply of inert gas, both control valves are open, and the control valve 15 is closed after the lapse of a certain period of time, so that a relatively small quantity of inert gas is supplied through the line 17. This embodiment has the advantage that the control valve 15 does not require a continuous control but may be built in the form of a simple open-close-valve. This feature increases also the safety condition of the plant.

Practice has shown that in case of trouble or shut-down of the plant on purpose the use of the here shown method keeps all nozzle openings free, maintains open the channel-like connections between the nozzle openings and the hot fluidized bed matter, and prevents the oxygen nozzles from being damaged when a failure of the cooling-water supply occurs.

I claim:

1. A method for the operation of a melt-down gasifier or other apparatus for making liquid pig iron or steel starting material, which apparatus includes water cooled nozzles for introducing a measured quantity of oxygen-containing gas into the apparatus at a normal operating pressure, the method comprising the steps of:

detecting any reduction of the supply of water to the nozzles below a predetermined quantity, terminating the supply of oxygen-containing gas to the nozzles in response to the detected reduction, feeding an inert gas into the nozzles in an initial amount sufficient to maintain the pressure within the apparatus for an initial period of time following the terminating step, and reducing the quantity of inert gas fed into the nozzles after the initial period of time.

2. The method of claim 1 wherein the reducing step comprises reducing the quantity of inert gas fed into the nozzles to about 30% of the quantity of oxygen-containing gas fed at normal operating pressure.

3. The method of claim 1 or 2 wherein said feeding step comprises supplying inert gas to the nozzles through at least two parallel lines, and the reducing step comprises terminating the flow through one or more of the parallel lines.

4. A method for the operation of a melt-down gasifier or other apparatus for making liquid pig iron or steel starting material, which apparatus includes water cooled nozzles for introducing a measured quantity of oxygen-containing gas into the apparatus at a normal operating pressure, the method comprising the steps of:

monitoring the supply of oxygen-containing gas and water to the apparatus, terminating the supply of oxygen-containing gas to the nozzles upon the detection of any reduction of the supply of oxygen-containing gas or water below predetermined quantities, feeding an inert gas into the nozzles in an initial amount sufficient to maintain the pressure within the apparatus for an initial period of time following the terminating step, and reducing the quantity of inert gas fed into the nozzles after the initial period of time.

5. The method of claim 4 wherein the reducing step comprises reducing the quantity of inert gas fed into the nozzles to between about 25% and about 30% of the quantity of oxygen-containing gas fed at normal operating pressure.

6. The method of claim 4 or 5 wherein during the reducing step, the quantity of inert gas fed into the nozzles is determined by the cause of the terminating step.

7. In a melt-down gasifier or other apparatus for making liquid pig iron or steel starting material, which apparatus includes water cooled nozzles connected to a supply of water and a supply of oxygen-containing gas for introducing a measured quantity of oxygen-containing gas into the apparatus at a normal operating pressure, the improvement comprising:

monitoring means for monitoring the supply of water to the nozzles of the apparatus, means coupled to the monitoring means for terminating the supply of oxygen-containing gas to the nozzles upon the detection by the monitoring means of any reduction of the supply of water below a predetermined quantity, means coupled to the nozzles for feeding an inert gas from a supply thereof into the nozzles in an initial amount sufficient to maintain the pressure within the apparatus for an initial period of time following any termination of supply of oxygen-containing gas, and means for reducing the quantity of inert gas into the nozzles after the initial period of time to an amount sufficient to prevent nozzle constriction or damage.

8. The improvement of claim 7 wherein the means for feeding inert gas from a supply thereof comprises at least two lines connected in parallel between the supply of inert gas and the nozzles.

9. The improvement of claim 8 wherein said means for reducing the quantity of inert gas comprises valve means located in less than all of the at least two lines for terminating the flow of inert gas therethrough.

10. The improvement of claim 8 wherein the lines are of different size.

* * * * *